United States Patent [19]

Feldman

[11] Patent Number: 4,759,543

[45] Date of Patent: Jul. 26, 1988

[54] PASSIVE EXERCISE CUSHION

[76] Inventor: Susan M. Feldman, 2259 E. 18th St., Brooklyn, N.Y. 11229

[21] Appl. No.: 923,565

[22] Filed: Oct. 27, 1986

[51] Int. Cl.[4] ..... A63B 21/00; A47C 3/00

[52] U.S. Cl. ..... 272/93; 297/DIG. 3; 297/284

[58] Field of Search ..... 297/230, 284, 460, DIG. 3; 272/93, 130, 109, 143, 144, 135–142; 5/432, 446, 447; 128/70, 68, 69

[56] References Cited

U.S. PATENT DOCUMENTS

| | | | |
|---|---|---|---|
| 3,145,054 | 8/1964 | Sopko | 297/DIG. 3 |
| 3,495,871 | 2/1970 | Resag et al. | 297/284 |
| 3,778,851 | 12/1973 | Howorth | 272/109 |
| 4,108,492 | 8/1978 | Kirby | 297/DIG. 3 |
| 4,516,568 | 5/1985 | Baxter et al. | 297/460 |
| 4,534,593 | 8/1985 | Ojala | 297/284 |

*Primary Examiner*—Richard J. Apley
*Assistant Examiner*—S. R. Crow
*Attorney, Agent, or Firm*—Natter & Natter

[57] ABSTRACT

A passive exercise cushion for alleviating and preventing back pain includes a plurality of air inflatable component members encased within a fabric covering. The covering includes a strap member for securement to a backrest of a chair. A pillow member within the casing is positioned in confronting relationship for cradling the back when sitting in the chair. A support mat within the casing provides cushion firmness. A pouch placed between the pillow member and the support mat is adjustably positionable at preselected areas, the locus of which extends between the lower limit of the scapula and the fourth lumbar vertebrae of the back. The volume of air within the pouch is controlled so that when the reclining back assumes a comfortable position in the chair, a forwardly directed force is exerted by the pouch. Bodily equilibrium is passively maintained by counterbalancing contraction of the muscles supporting the spinal system and thus provide a strengthened and conditioning action.

15 Claims, 2 Drawing Sheets

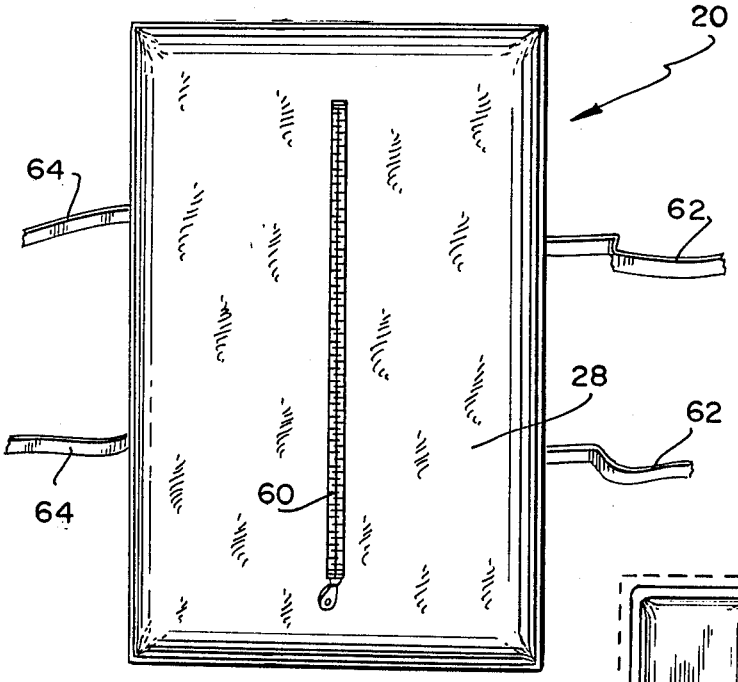
FIG. 1
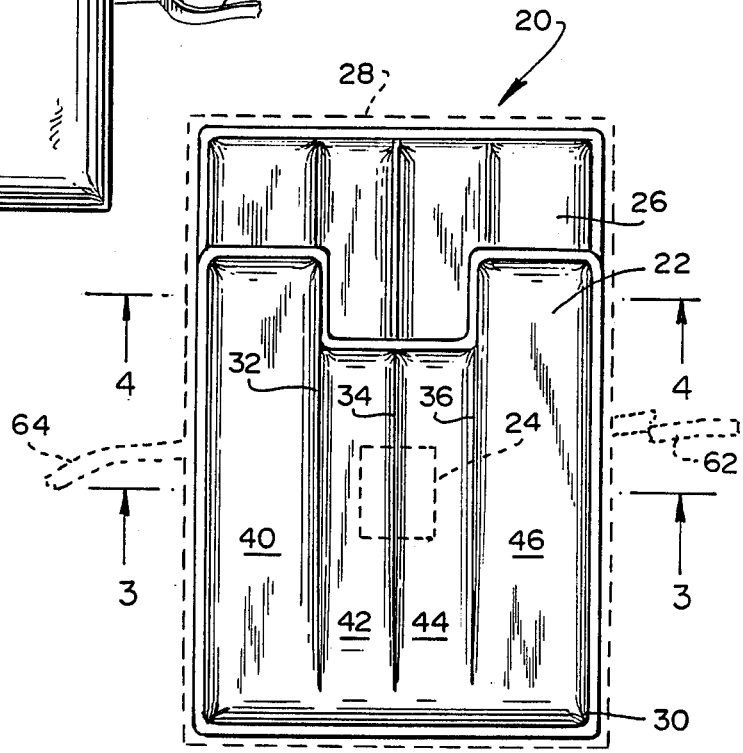
FIG. 2
FIG. 3
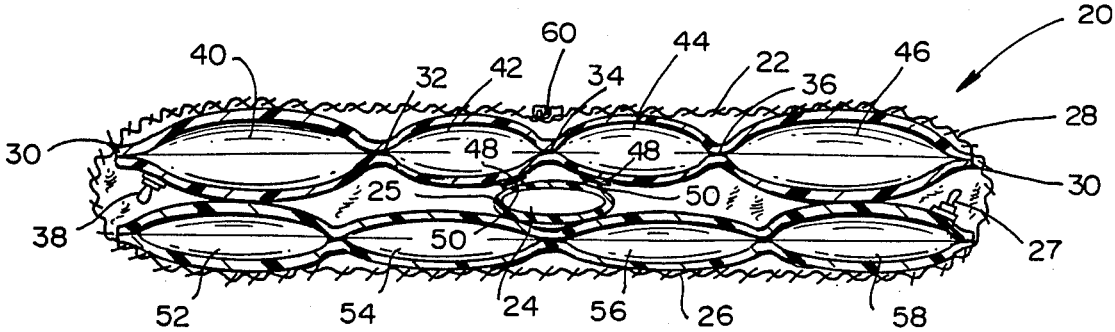

PASSIVE EXERCISE CUSHION

BACKGROUND OF THE INVENTION

1. Field of the Invention

This invention relates to therapeutic appliances and especially to devices for preventing and relieving back pain in the human body.

In particular, the passive exerciser of this device concerns a cushion which is adapted for providing a treatment and exercise modality for strengthening muscle tissue of the spinal support system.

2. Description of Related Art

Backache is an affliction that affects approximately 80% the population sometime during their lifetime.

It is generally accepted that poor posture and muscular imbalances are common causes of back pain. When a person assumes a slouching, round shoulder, or sway-back position, this can change the normal curvature of the spine and put abnormal stress on the supporting muscles and ligaments. Poor posture is frequently associated with weakened muscles which cause the spinal support system to lose stability.

Potential back pain problems can be prevented by maintaining proper muscle conditioning and by practicing good posture. It has also been found that exercise therapy can relieve back injury and similar dysfunctions. Most exercise therapies, however, require a concerted effort by the patient and it has been found that once the pain is alleviated, the exercises are no longer pursued. Often the salubrious effects of the treatment are short-lived and the backache again returns.

The device of this invention provides a passive exercise cushion which can readily be adapted to an individual's lifestyle. It has been found that a majority of patients assume a sitting position for a substantial part of the day. Sitting, however, prompts poor posture—the abdomen protrudes, the low back sways, and the upper back tends to hump over.

The device of this invention is advantageously adapted for use while in a sitting position and provides a back support which encourages proper posture. Additionally, the muscles that support the spine are concomitantly exercised for maintaining back fitness.

Previous devices had attempted to relieve back pain. Those devices, however, were typically directed to back supports such as is illustrated in U.S. Pat. Nos. 3,279,849, 3,348,880, 3,540,776, 4,108,492, 4,190,286 and 4,516,568. A disadvantage of those devices was that they were concerned primarily with providing comfort and localized support to different areas of the back such as the lumbar and sacroiliac areas.

A further shortcoming of those backrests was that they employed horizontally positioned cushion segments and consequently a gap or bridge occurred between respective cushions and the back was unsupported at those locations. Accordingly, those support devices did not conform to the back contours or adequately cradle the back. Furthermore, those devices were not designed to provide a forwardly directed force on the back through air-inflatable segments so as to provide an exercise modality.

Although inflatable devices were shown, for example, in U.S. Pat. Nos. 4,516,568 and 4,190,286, those devices were intended to comfortably accommodate the user rather than to apply a forwardly directed thrust to the back and consequently they did not function as a passive exercise device as in the present device.

SUMMARY OF THE INVENTION

Briefly, the nature of this invention concerns a passive exercise cushion. The device is adapted for placement against a backrest of a conventional chair and provides an exercise modality for a human back.

The device includes a resilient compartmentalized air inflatable pillow conforming generally in size to the backrest. The pillow is intended to provide cradled support for the back.

An air-filled pressure pouch is detachably secured behind the pillow at a location corresponding to the middle portion of the back. Specifically, the pressure pouch is positioned between the lower margin of the shoulders or scapula bone and the fourth lumbar vertebrae of the spine. The location of, and air pressure in the pouch is adjusted in accordance with the anatomy of the back so as to provide the desired results when reclining against the cushion.

A support mat is placed over the pressure pouch and is otherwise contiguous to the first-mentioned pillow. The aforementioned components are enclosed within an enveloping fabric cover. The cover includes straps for attaching the exercise cushion to the backrest of the chair.

Alternate applications of the exercise cushion include placement of the cushion against a vertical wall surface or a horizontal floor surface.

A feature of this invention is that as one reclines against the exercise cushion, a forward thrust or force is exerted by the pressure pouch and the muscle groups of the abdominal cavity automatically react in response and are thereby contracted and are strengthened. Furthermore, prescribed body movements can be subtly performed while sitting for exercising specific muscle groups.

Having thus summarized the invention, it will be seen that it is an object thereof to provide a passive exercise cushion of the general character described herein which is not subject to the aforementioned disadvantages.

Specifically, it is an object of this invention to provide a passive exercise cushion utilizing a plurality of longitudinal air chambers which conform to and cradle the back without leaving any unsupported areas.

A further object of this invention is to provide a passive exercise device which applies pressure to the region proximate the middle of the back wherein equilibrium is maintained by counterbalancing muscular contraction of the muscles of the spinal support system.

A still further object of this invention is to provide a passive exercise cushion for use in conjunction with an exercise program directed to conditioning muscles of the spinal support system.

Still another object of this invention is to provide a passive exercise cushion of the general character described which is simple in construction, low in cost, and reliable in use, and well adapted for mass production and fabrication techniques.

Other objects of the invention in part will be apparent and will be pointed out hereinafter.

With these ends in view, the invention defines embodiment in certain combinations of elements and arrangement of parts by which the aforementioned objects and certain other objects are hereinafter attained, all as fully described with reference to the accompanying drawings and the scope of which is more particularly pointed out and indicated in the appended claims.

BRIEF DESCRIPTION OF THE DRAWINGS

In the accompanying drawings in which is shown a possible exemplary embodiment of the invention:

FIG. 1 is a plan view of a passive exercise cushion of this invention showing a fabric cover having a slide fastener for providing access to the interior thereof and a pair of straps for securement of the cushion to a chair;

FIG. 2 is a plan view of the cushion device of this invention with the fabric cover removed showing a pillow member, a pressure pouch (in broken lines) and a support mat; FIG. 3 is a sectional view taken substantially along line 3—3 of FIG. 2 showing the arrangement of the pillow member, the pressure pouch, and the support mat including the enveloping fabric cover;

DESCRIPTION OF THE PREFERRED EMBODIMENT

Figure 4:
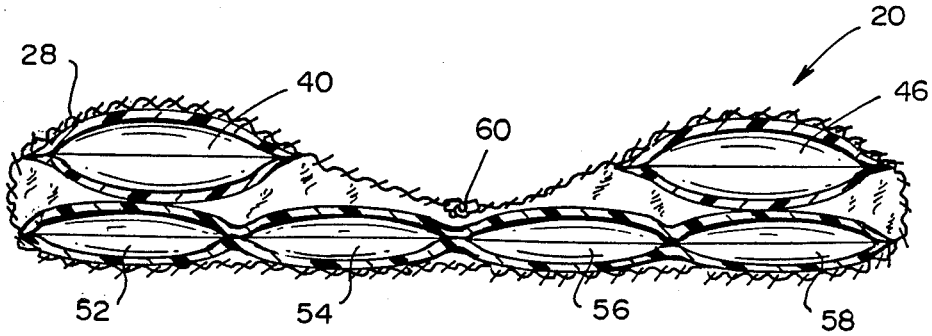
FIG. 4 is a sectional view taken substantially along line 4—4 of FIG. 2 showing the pillow member, the support mat and the fabric cover.

Referring now in detail to the drawing, the reference numeral 20 denotes generally a passive exercise cushion in accordance with this invention. The cushion 20 as illustrated in the embodiment shown in FIGS. 2–4, includes three interdependent, air inflatable, components—a back cradling pillow member 22, a pressure pouch 24, and a support mat 26. The aforementioned components are encased within a fabric cover 28.

In a typical embodiment, the dimensions of the cushion 20 conform to the anatomical proportions of the patient. It is intended that when the cushion is placed contiguous to a backrest of a conventional chair, it will extend from the base of the spine or coccyx to the shoulder or upper limits of the scapula. The width of the cushion 20 should be sufficient for extending between the lateral margins of the patient's back and hips.

The pillow member 22, is preferably fabricated from an air impervious material such as vinyl plastic and includes a peripheral seam 30 and longitudinal seams 32,34,36. The seams 30–36, can, for example, be formed during manufacture using an electronic welding application. In addition, the pillow member 22 includes an inflation valve 38.

It should be noted that the longitudinal seams 32,34,36 effectively segment the pillow 22 into a pair of lateral air chambers 40,46 and a pair of spinal support air chambers 42,44. The longitudinal seams 32–36 do not extend, in one direction, to the peripheral seam 30 and the air chambers 40–46 will thus be in air-communication. It should be further noted that the lateral air chambers 40,46 span from the base of the spine to the upper limit of the scapula. The spinal support air chambers 42,44 terminate at the lower limit of the scapula.

The pressure pouch 24, is comprised of a single air chamber having a similar construction to that previously described in conjunction with the pillow 22. The pressure pouch 24 is adapted for adjustable attachment to the spinal support air chambers 42,44 and for that purpose has been provided with hook and loop type fastening arrangement. In the embodiment shown, a pair of strips 48 having lopp material has been secured to the spinal support air chambers 42,44 of the pillow 22. A corresponding set of strips with hook material 50 is secured to the pressure pouch 24 in registered alignment with the strip 48. The pressure pouch 24 can be thus affixed to the pillow 22 at selected locations.

The support mat 26, is intended to provide structural rigidity and firmness to the cushion 20 and includes in this preferred embodiment, four equal-width air chambers 52,54,56,58. Each of the chambers 52–58 are formed with longitudinal seams and the mat 26 is otherwise constructed substantially indentical to the pillow 22. It should be noted, however, that the mat 26 corresponds in size to the cover 28.

With regard to the cover 28, the fabric used preferably is a durable material e.g. a porous cotton/polyester composition providing air circulation for comfort. Furthermore, a slide fastener 60 provides access to the interior for adjustable positioning of the pressure pouch 24 and also for regulating air pressure within said components. The cover 28 is also provided with straps 62,64 for securing the pillow to the backrest of the chair.

Figure 5:
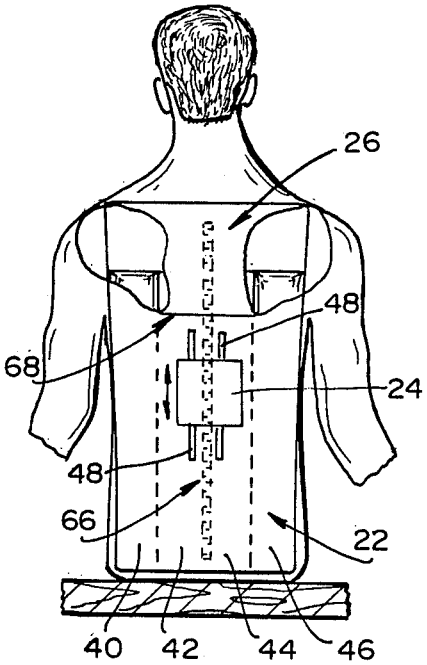
FIG. 5 is a view of the exercise cushion of this device superimposed upon a subject's back showing the positioning of the pressure pouch at the middle back area between the inferior scapula and the fourth lumbar vertebrae.
Figure 6:
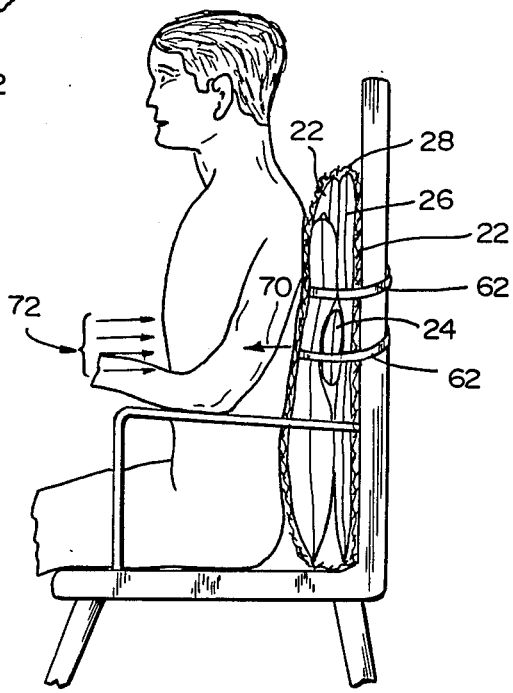
FIG. 6 is a side view of a subject sitting on a chair and a longitudinal sectional view through the exercise cushion of this device with a broken line arrow showing the direction of pressure generated by the pressure pouch as the subject leans back on the cushion and a plurality of oppositely directed arrows indicating the contraction of the abdominal muscles of the subject.

The use and operation of the cushion 20 will now be described with particular reference to FIGS. 5 and 6. The cushion 22 should be individually adjusted, preferably by a chiropractor or health professional, with regard to air inflation and to positioning of the pressure pouch 24. The pressure pouch 24 should be secured to the spinal support chambers 42,44 at a location between the fourth lumbar vertebrae 66 and the lower limits of the scapula 68. The air pressure in each of the pillow 22, pressure pouch 24 and support mat 26 should be adjusted through respective valves 28,25,27 such that when the patient is seated with his back against the cushion 20, the cradle pillow 22 should conform to the surface of the back and the pressure pouch 24 should exert a forwardly directed force as indicated by the arrow 70.

In this regard it should be noted that the spinal support air chambers 42,44 have a volumetric capacity less than the lateral air chambers 40,46 and upon application of a reclining back pressure the air within the pillow 22, will unequally distribute in favor of the lateral air chambers 40,46. Consequently, the forward thrust of the pressure pouch 24 will be more effectively transmitted to the back.

As previously discussed, a counterbalancing force will be exerted by the parallel abdominal muscles and related sets of back muscles which support the spine, such as the erector spinea, the rectus abdominus, the lateral muscles, the hip flexor muscles and the gluteal muscles. The stretching and contraction of these muscles are indicated generally by the several arrows designated as 72 and this will occur as a natural reaction to the forwardly directed force 70. It is, however, within the scope of this exercise cushion to develop active exercises directed to one or more muscle groups, which can be achieved, for example, by moving the neck, elevating the leg, raising and lowering the arms and by turning the head.

It should be apparent therefore that use of the passive exercise cushion of this invention for muscle conditioning, can be accomplished during daily activities while sitting and without much inconvenience or concerted effort by the user.

It is also within the scope of this invention to utilize the exercise cushion 20 by placement against a vertical wall surface or on a horizontal floor surface wherein similar exercise routines can be performed.

The cushion 20, may also be worn or otherwise secured to the body in juxtaposition with the back. In this modality, the straps 62,64 are tightly fastened around the torso so that the pressure pouch 24 will provide a forward thrust. This application is particularly directed to improving posture while standing walking and lifting and for simultaneously providing muscle conditioning.

The cushion 20 can also be proportionally reduced in size for accommodation within or for incorporation with a body encircling garment such as a girdle or belt. In this manner, the cushion 20 can be concealed beneath an outer garment.

Thus, it will be seen that the passive exercise cushion achieves the various objects of the invention and is well adapted to meet conditions of practical use.

Since various possible embodiments might be made for the present invention and various changes might be made in the exemplary embodiments set forth, it is to be understood that all materials set forth or shown and described in the accompanying drawings is to be interpreted as illustrative and not in a limited sense.

Having thus described the invention, there is claimed as new and desired to be secured by Letters Patent:

1. A passive exercise cushion for conditioning the muscles of the spinal support system of the human back comprising inflatable pillow means adapted for yieldably conforming to the contours of the back, support mat means co-acting with the pillow means for providing firmness to the cushion, pressure pouch means positioned between the pillow means and the support mat means, attachment means for securing the pressure pouch means at selected locations with regard to the pillow means, said pillow means including a plurality of longitudinal air chambers, said air chambers being in communication for redistribution of the air therein in response to a back reclining pressure exerted thereon, said air redistribution further being effective for transmitting a forward thrust through interaction with the pressure pouch means whereby bodily equilibrium is maintained by the counter-balancing contraction of the muscles supporting the spinal system.

2. A passive exercise cushion as claimed in claim 1 wherein the pillow means includes at least one spinal support air chamber and a pair of lateral chambers.

3. A passive exercise cushion as claimed in claim 2 wherein the volumetric capacity of the spinal support air chamber is less than the lateral air chambers.

4. A passive exercise cushion as claimed in claim 2 wherein the pressure pouch means is attachable to the spinal support air chamber.

5. A passive exercise cushion as claimed in claim 1, wherein the pillow means, support mat means, and pressure pouch means, are encased within a cover.

6. A passive exercise cushion as claimed in claim 1, wherein the forward thrust exerted by the pressure pouch is dependent upon the air pressure within the pillow member and the pressure pouch.

7. A passive exercise cushion as claimed in claim 1, wherein the air chambers are parallel to the spine.

8. A passive exercise cushion as claimed in claim 4, wherein the pressure pouch is positioned between the lower limit of the scapula and the fourth lumbar vertebrae for providing the forward thrust to the back.

9. A passive exercise cushion as claimed in claim 1, wherein the support mat conforms in size to the cover.

10. A method for strengthening abdominal muscle groups within the human body comprising the following steps:

providing an air inflatable pillow for cradling the human back;

maintaining the desired firmness of the air pillow by contiguous placement of an air inflatable support mat;

positioning a pressure pouch between the pillow and the support mat;

controlling the volume of air within the pressure pouch;

reclining the back against the air cushion and, concomitantly redistributing the air within the pillow for interaction with the pressure pouch whereby a forwardly direct thrust is applied through the pillow and against the back; and exerting a counterbalancing muscular force to maintain bodily equilibrium.

11. A method as claimed in claim 19, wherein the forward thrust is applied at a location between the lower limits of the scapula and the fourth lumbar vertebrae.

12. A method as claimed in claim 11, wherein the thrust is applied by an inflatable pressure pouch within the cushion.

13. A method as claimed in claim 12, further including a step of:

elevating the legs while reclining against said cushion for exercising specific muscle groups.

14. The method as claimed in claim 12, including the further step of:

stretching the neck rearwardly while reclining against said cushion for exercising specific muscle groups.

15. The method as claimed in claim 12, further including the step of:

moving the head forward while reclining against said cushion for exercising other specific muscle groups.

* * * * *